United States Patent [19]

Robbins

[11] 4,453,459

[45] Jun. 12, 1984

[54] CAN CRUSHER

[76] Inventor: Paul J. Robbins, 387 West 5900 South, Murray, Utah 84107

[21] Appl. No.: 384,007

[22] Filed: Jun. 1, 1982

Related U.S. Application Data

[63] Continuation-in-part of Ser. No. 166,592, Jul. 7, 1980, abandoned.

[51] Int. Cl.[3] ..... B30B 9/32

[52] U.S. Cl. ..... 100/35; 100/215; 100/244; 100/902

[58] Field of Search ..... 100/35, 902, 244, 264, 100/215; 241/99, 266

[56] References Cited

U.S. PATENT DOCUMENTS 2,773,536 12/1956 Lange ..... 100/264
3,048,096 8/1962 Guedel ..... 100/902
3,608,478 9/1971 Hoffman ..... 100/244

FOREIGN PATENT DOCUMENTS 1244682 7/1967 Fed. Rep. of Germany ..... 100/902
805030 11/1958 United Kingdom ..... 241/266

*Primary Examiner*—Billy J. Wilhite
*Attorney, Agent, or Firm*—Trask & Britt

[57] ABSTRACT

An apparatus and method for crushing cylindrical cans is disclosed. The apparatus and method are particularly useful for crushing cylindrical beverage cans such as those commonly used as containers for soft drinks and beer. The cans are crushed along their longitudinal axes by parallel crushing faces which each move towards each other along predetermined arcual paths. The faces are continuously moving along an arcual path so that the faces crush the can and then move away from the can to discharge it from the bottom of the apparatus.

14 Claims, 17 Drawing Figures

CAN CRUSHER

RELATED APPLICATIONS

This application is a continuation-in-part of application Ser. No. 166,592, filed Jul. 7, 1980, entitled "Can Crusher" now abandoned.

BACKGROUND OF THE INVENTION

1. Field

This invention relates to can crushers of the type used for crushing small cylindrical cans such as those used for soft drinks, beer and the like.

2. State of the Art

Various types of can crushers have been heretofore developed. Roller-type crushers are typical of can crushers wherein the crushing action is random, i.e., the can enters between roller at any of various attitudes.

A plate-type crusher which crushes cans in random fashion is illustrated in German Pat. No. 1,244,682. Cans enter between slanted crusher jaws which are spaced further apart at the top than at the bottom so that a can which is partially crushed between the top portion of the jaws drops to the low section of the jaws wherein the cans are further crushed to a smaller size. The small cam operation of the crushing jaws provides a very short throw whereby the crushing of a single can requires several back and forth motions of the jaws.

A can crusher with parallel plates is illustrated in U.S. Pat. No. 2,773,536. The crushing plates are actuated toward one another by threaded drive rods. To drive the crusher jaws towards one another the threaded rods rotate in one direction while the opening of the jaws then requires the rotation of the threaded rods to be reversed.

OBJECTS OF THE INVENTION

It is an object of the instant invention to provide a small, reliable, efficient can crusher which requires a minimum amount of power and is quiet in operation.

A further object of the instant invention is to provide a can crusher which rapidly crushes one or more cans into a small disk-shaped product.

Another object of the instant invention is to crush a small cylindrical beverage can along its longitudinal axis to produce a small disk-shaped final product.

DESCRIPTION OF THE INVENTION

Figure 1:
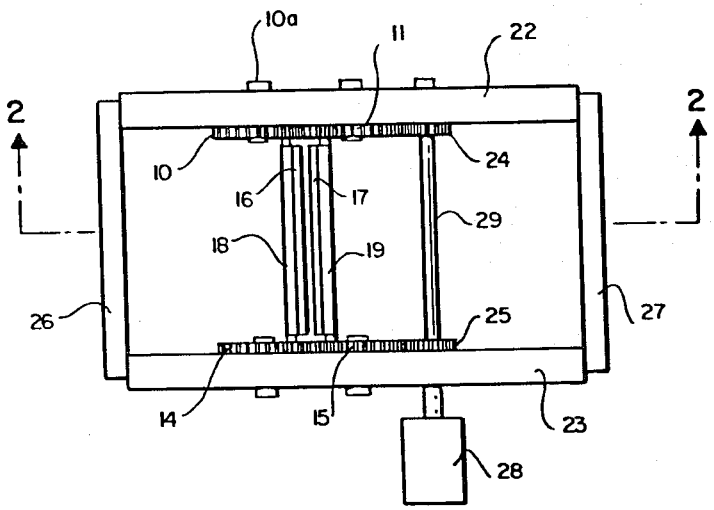
FIG. 1 is a plan view of the can crusher of the instant invention.

The instant invention relates to a method and apparatus for crushing cylindrical cans along their longitudinal axes. The cans are typically of the type used for beverages such as soft drinks, beer and the like. A can is positioned in the device so that its longitudinal axis is substantially perpendicular to and between a pair of substantially parallel, opposed, planar faces. Each face is moved towards the other face, generally along an arcual path from a position of maximum spacing between faces to a proximal position while maintaining the faces during movement in a substantially parallel position with respect to one another. The faces continue moving, generally along the same arcual path from a proximal position to a position of maximum distance between one another. The faces move in a smooth continuous fashion from a fully open to a closed to fully open position. This generally constitutes one complete crushing action which crushes the can and then opens the faces to discharge the can.

The method and apparatus also include means for feeding or introducing cans into the crushing apparatus and means within the apparatus for positioning a cylindrical can so that its longitudinal axis is substantially perpendicular to and between the pair of substantially parallel, opposed planar faces.

The apparatus and method of this invention crush cans so that the lids of the crushed can remain substantially parallel and are not substantially displaced axially from one another. Thus, the cylindrical walls of the can are collapsed so that one lid becomes substantially superimposed upon the lid, i.e., end of the container. For a typical beverage can having a height of about six inches and diameter of about two inches the crushed product continues to have a diameter of about two inches but a height of less than about one-half inch to one inch.

It is important to have the cylindrical can properly aligned with the planar faces of the crushing mechanism. If the can is askew with respect to the faces the crushing action will tend to crush the can in an abnormal manner or will "pop" the can out from between the crushing faces.

Also, crushing the cylindrical can along its longitudinal axis requires a minimum amount of energy because the can walls are very thin and more easily crushed than the can lid.

All the drawings and description herein generally refer to the crushing of a single can, although the size of the crusher faces may be such that several cans can be crushed at the same time. Again, it is desirable to have the axes of the cans substantially perpendicular to the crusher faces. The technique of crushing several cans at the same time is the same as crushing one can, however, the apparatus must be constructed to accept slightly greater stress on its various parts and to have a more powerful prime mover in order to crush several cans simultaneously. Generally, this particular apparatus is especially useful for installation in restaurants, taverns and similar establishments. It has a fast operation in crushing one can or more cans in a single cycle. Because of its fast operation the faces need not be sized to crush more than one can per cycle.

Further description of the instant invention may be facilitated by reference to the attached drawings. FIG. 1 is a plan view of the can crushing apparatus as viewed from the top. Although the drawings attached hereto generally show the can in a horizontal position during crushing, it is recognized that the can may be crushed while in a vertical position although a slightly different feed mechanism to feed the cans in between horizontal crusher faces may be required. The faces of the crusher plates are oriented in a horizontal plane when cans to be crushed are oriented vertically. Also, if desirable, the cans can be crushed with the longitudinal axes of the cans at any angle with respect to the horizontal, so long as the faces are canted so that each can has its axis perpendicular to the crusher face surface. Having the cans drop between vertical faces is preferred inasmuch as the feeding and discharging of cans requires only the force of gravity.

In FIG. 1 the circular crusher gears or sprockets are identified as gears 10, 11, 14 and 15, which are the upper crusher gears and are in opposed relation, that is, gear 10 is in register and opposed to gear 14 while the same relationship is true between gears 11 and 15. Shafts 18 and 19 are the upper shafts which are attached to plates 16 and 17. The shafts 18 and 19 may be rigidly attached to their respective gears but pass through bearings attached to the crushing plates so that the shafts may rotate one revolution with respect to the crusher plates while the crusher plates are completing one complete cycle between their proximal and distal positions. Flat sidewalls 22 and 23 provide vertical support walls for the structure and are maintained and supported in their relative parallel positions to one another by end walls 26 and 27. A motor or prime mover 28 drives a pair of drive gears 24 and 25 through means of a common drive shaft 29.

Figure 2B:
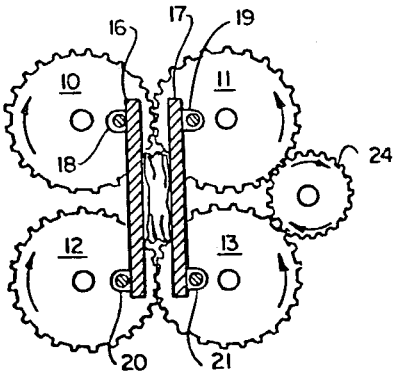
FIGS. 2A and 2B are sectional elevational views of the crusher of FIG. 1 along section lines 2—2 with FIG. 2A showing the crushing plates in an open position and FIG. 2B showing the crushing plates in their closed, proximate position.
Figure 2A:
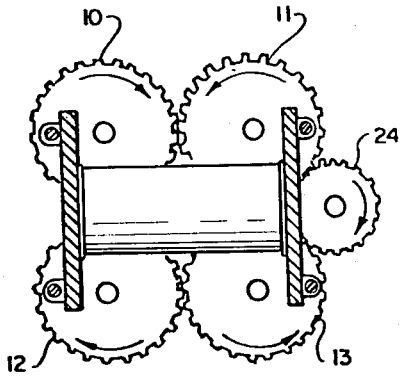

FIGS. 2A and 2B illustrate the crushing mechanism involved in the apparatus and method of the instant invention. FIGS. 2A and 2B are sectional views along section lines 2—2 of FIG. 1. As drive gear 24 is turned clockwise, it drives gears 11 and 13 in a counterclockwise direction. Gears 11 and 13 drive gears 10 and 12, respectively, in a clockwise direction. FIG. 2A shows the crushing faces 16 and 17 in their open position with an uncrushed can located therebetween. As gears rotate, the plates move along an arcual path (which is a circular path in FIGS. 2A and 2B) until the plates reach their proximal or closest position as shown in FIG. 2B thereby crushing the can along its longitudinal axis to substantially superimpose its one lid upon the other lid.

Since gear 24 intermeshes with gears 11 and 13 which intermesh respectively with gears 10 and 12, the faces move in a parallel relation to one another. The faces are attached to respective gears by shafts 18, 19, 20 and 21, respectively, to gears 10, 11, 12 and 13. The shafts 18, 19, 20 and 21 are generally affixed near the outer perimeter of each gear. The apparatus is oriented so that the faces of the crushing plates remain in a substantial vertical plane while the shafts 18 and 19, during rotation are always in the same horizontal plane. The same relationship is true of shafts 20 and 21.

Figure 3:
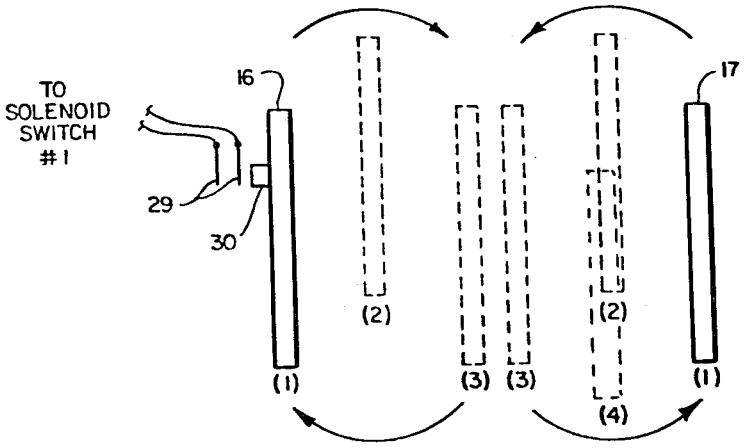
FIG. 3 is a schematic view showing the movement of the crushing faces in their travel from remote to proximate positions.

The movement of the crusher faces 16 and 17 is illustrated in FIG. 3. As plate 16 moves in an arcual path it begins at position (1) which is its farthest distance from plate 17. It then moves upward and forward along an arcual path until it reaches position (2) which is forward of and above position (1). Plate 17 is simultaneously experiencing the same motion moving from position (1) to a position (2) which is above and forward of position (1). Generally, before plates 16 and 17 reach position (2) they will have made contact with the can to be crushed and picked it up from any rest or positioning cradle. This upward and forward movement of the crushing faces is particularly desirable inasmuch as it moves the can to be crushed above a rest or positioning structure so that during the crushing operation the rest or positioning structure will not interfere with the collapsing of the can sidewalls nor will such positioning structure become caught within the can sidewalls.

The two faces continue to move towards one another moving from position (2) forward and downward to position (3) which places the crusher faces in their closest proximity. The faces continue along the curved path moving from position (3) away from one another and downward as shown at position (4), which is the lowest position the plates reach. The plates then move away from one another and upward to return to position (1). As the plates move from position (3) to position (4) the crushed can will be released and allowed to fall from the bottom of the crusher into a receptacle or storage bin.

Also in FIG. 3, a switch 29 is illustrated wherein a switch contact 30 attached to the back of one of the plates, for example plate 16, causes the two elements of the switch to be pressed together as the plate 16 returns to position (1) thereby signaling a feed mechanism to feed another can into the device. Thus, the crusher can be controlled to complete one cycle and stop. Cycling of the crusher faces can be controlled manually or can be controlled to start another cycle by the presence of another can to be fed to the crusher.

Figure 4:
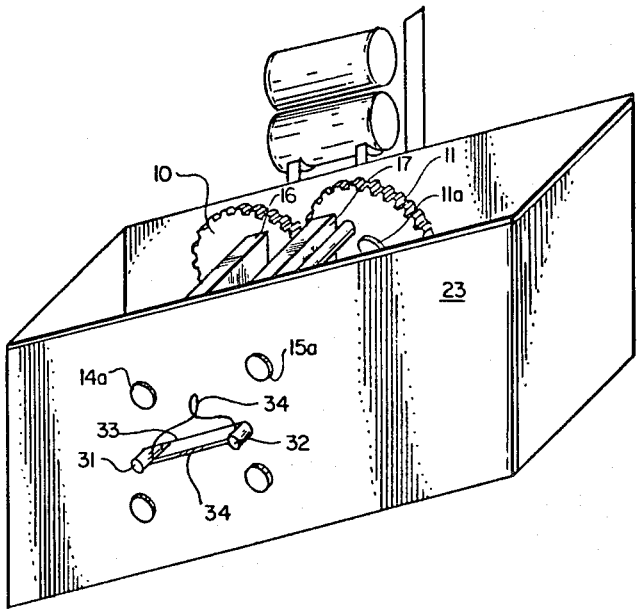
FIG. 4 is a perspective view of the can crusher showing the can feed mechanism.
Figure 7:
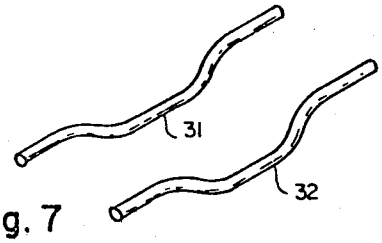
FIG. 7 is a perspective view of a pair of positioning rods with dished mid-sections.
Figure 5B:
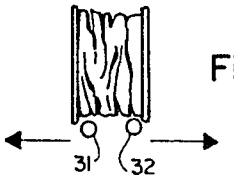

An overall view of a typical can crusher of this invention is provided in a perspective view illustrated in FIG. 4. The crushing plates 16 and 17 are shown in a partially closed position with a rack of cans shown above the crushing plates. The pins or axles holding the various crusher gears in position are also shown pins 10A, 11A, 14A, 15A, respectively, holding gears 10, 11, 14 and 15 in position. A pair of rest rods or supports 31 and 32 are shown projecting from the sidewall 23 of the device and residing within a slotted opening 33. Rods 31 and 32 may have the general shape shown in FIG. 7 wherein a dished section is provided in the midportion of each rod. The dished portion permits the can to rest therein thereby aligning the can both vertically and laterally so that its faces or lids are parallel to the crushing plate faces and its longitudinal axis is substantially perpendicular to the crusher plate faces. The slot 33 is placed so that the rods 31 and 32 are between the upper and lower gears. The dished shape of rods 31 and 32 provide a cradle for cans whereby the cradle is sufficiently low so as not to interfere with the can while it is being crushed.

A spring 34, which is a hairpin type spring, holds the rest rods 31 and 32 apart so that the rods will contact a typical can somewhat near the ends of the can. It is generally desired that the rods contact the can so that at least one-half length of the can is positioned between the separated rods 31 and 32. The spring 34 and slot 33 allow rods 31 and 32 to move together as the crusher faces crush the can. As heretofore indicated, the general motion of the face plates is upward from the maximum open position to a partially closed position wherein the upward motion picks the can up off the rests so that there is very little possibility of the rest rods interferring with the crushing of the can.

Figure 5A:
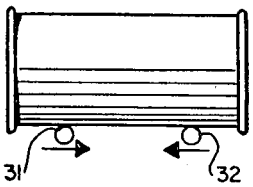
FIGS. 5A and 5B show the positioning rods on which a can rests during its initial positioning within the crusher while the movement of said rods during the crushing to their proximate position is shown in FIG. 5B.

As illustrated in FIGS. 5A, 5B, 6A and 6B the rest rods move from a fully opened position towards one another as the uncrushed can, illustrated in FIG. 5A, is crushed then rods 31 and 32 move towards one another. Upon the completion of crushing of the can the crushed can product (FIG. 5B) is shown resting upon rods 31 and 32. As the crushing faces move away from one another, rods 31 and 32, because of the force of spring 34, will part, allowing the crushed can to fall between the rods to a storage receptacle.

Figure 6A:
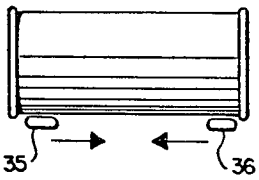
FIGS. 6A and 6B show flat rods as positioning rods.
Figure 6B:
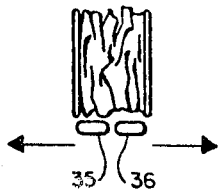

FIGS. 6A and 6B illustrate the same action of the rest rods showing the rest rods 35 and 36 to have a slightly greater width than height since it may be somewhat advantageous to have rest rods which have a slightly greater surface area to prevent the rest rods from becoming caught in a fold of the sidewall of a can while it is being collapsed. This particular type of rest rod is particularly advantageous for a can crushing action wherein the crusher faces do not travel in an arcual path but travel a straight line or reciprocal path between their closing and opening positions.

Figure 8:
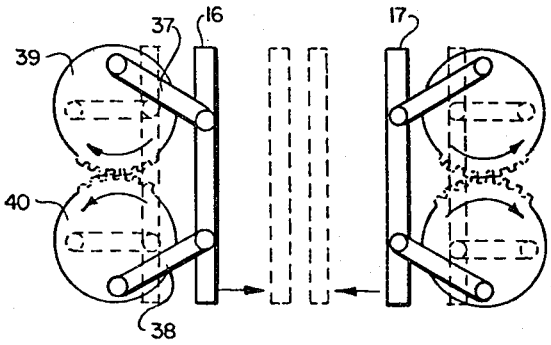
FIG. 8 is a partial elevational section view of a can crusher which converts the revolving motion of the gears to straight, reciprocal motion of the crusher plates.
Figure 9:
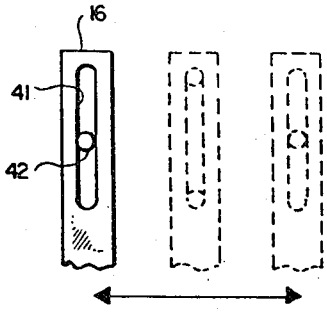
FIG. 9 is a partial elevational sectional view illustrating cam means for converting the revolving motion of the gears to a straight, reciprocal motion of the can crusher plates.

Crusher plates which move in a straight line towards one another are illustrated in FIGS. 8 and 9. As indicated hereinbefore, certain advantages exist for crusher plate faces which move in an arcual path in their opening and closing actions, however, a slightly greater machine or apparatus height may be required because of this arcual path movement. Thus, if it is desired to crush cans in a machine having a minimum of vertical height the method and apparatus illustrated in FIGS. 8 and 9 may be utilized.

In FIG. 8 a fragmentary sketch is shown of a mechanism for driving a crusher plate 16 by means of reciprocating rods 37 and 38. Rods 37 and 38 are rotatably joined to gears 39 and 40 which intermesh with one another, turning in opposite directions so that as gears 39 and 40 rotate the crusher plate moves its farthest open position to a closed position as the pins attaching rods 37 and 38 to gears 39 and 40 move from a 270° position to a 90° position (assuming the zero or 360° is at the upper, central portion of the gear). A track or rail in which the corners of the plate 16 may slide is not illustrated. Plate 17 would be similarly operated. The gears driving plate 17 may be interconnected with gears 39 and 40 by a chain drive or a spiral gear drive.

FIG. 9 is another illustration of using a circular motion of gears to transmit, by cam action, a straight reciprocal motion to crushing plate 16. As the gear turns, the cam slot 41 is engaged by pin 42 which is a mid position in the cam slot wherein plate 16 is at its farthest position from plate 17. As the gear turns in a clockwise direction it moves plate 16 to a mid-closed portion as the pin 42 moves into the upper regions of cam slot 41. As the gear continues its clockwise motion it moves plate 16 to a closed position as the pin reaches the 90° point in the travel of the gear. As the gear continues to move to the 180° point it returns the plate to a mid position and finally returning to the 270° point it returns the plate to its farthest open position.

The gears in FIG. 9 could have the same relationship as the gears in FIG. 8, that is, the gears on one side of the crusher, which are attached to a particular crusher plate, for example, plate 16 intermesh the upper and lower gears. This is in contrast to the system shown in FIGS. 1 and 2 wherein the upper gears on one side intermesh while the lower gears on that same side intermesh.

The commonality between the system shown in FIGS. 8 and 9 with that of FIGS. 1 and 2 is that it is generally two gears which are preferred on each side of a crushing plate, with four gears operating one crusher plate and four gears operating the other crushing plate.

Generally, in the apparatus shown in FIG. 8, for example, the top gear attached to plate 17 would be driven in the same direction as the bottom gear attached to plate 16. These two may be interconnected by a chain drive or worm gear so that the main power drive input may then be to any one of the four gears on either side of the apparatus. The apparatus of the system in FIG. 9 would work with the gears attached to one plate moving in either the same direction or opposite direction so that either the drive system of FIG. 2 or the drive system of FIG. 8 could be utilized with the motion imparting mechanism illustrated in FIG. 9. Generally, it may be preferable to use the drive system illustrated in FIG. 8 with that shown in FIG. 9.

The invention described herein utilizes gears or chains which intermesh directly with one another to provide a secure interlocked system wherein the gears and crushing plates must move precisely in the same fashion each time. The apparatus and method illustrated in FIGS. 1, 2, 3 and 4 have certain advantages over the system disclosed in FIGS. 8 and 9 inasmuch as no rails or guides or slides are needed for the crushing plates 16 and 17.

The apparatus illustrated in FIGS. 1 and 2 may be fed by hand. For example, a can may be picked up with a pair of tongs and placed between the faces in a fully open position. The motor can then be actuated to initiate motion of the crusher faces. As soon as contact is made by the crusher faces with the can, the tongs are released. The crusher faces continue to move until the can is crushed, discharged and the faces have returned to an open position where the motor may be turned off manually or by the action of a limit switch, such as illustrated in FIG. 3.

Figure 10:
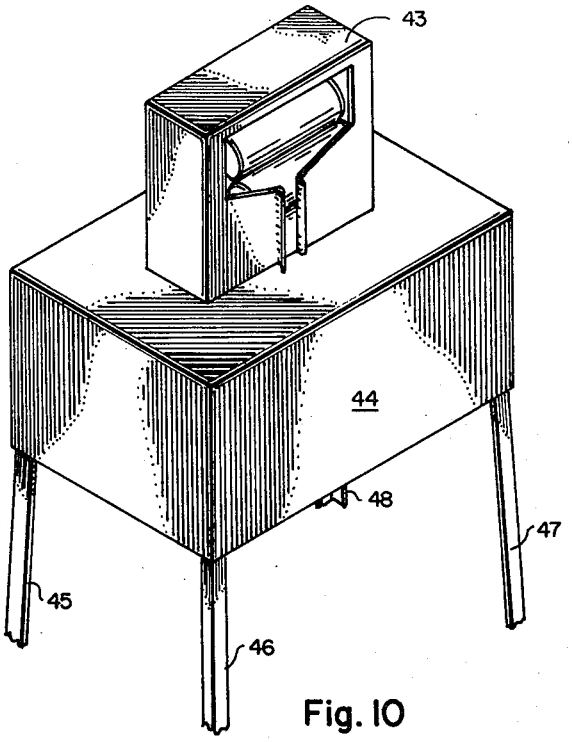
FIG. 10 is a perspective view of a can crusher with a vertical can holding chute.

The overall device is illustrated in FIG. 10 wherein a vertical tower or chute 43 is provided directly above the crusher mechanism, which is contained within housing 44. The housing has an open bottom through which cans are discharged. Legs 45, 46, 47 and 48 are provided to elevate the mechanism so that a receptacle for the crushed cans can be placed beneath the crushing mechanism.

Figure 11A:
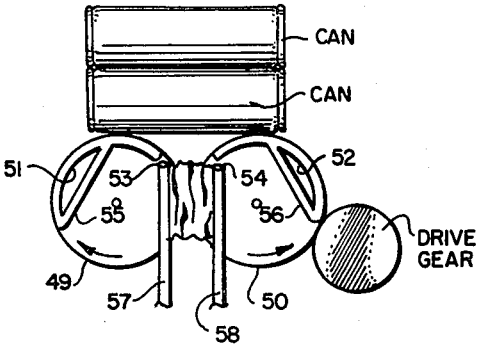
FIGS. 11A, 11B and 11C are elevational exposed views of the upper gear mechanism and automatic can feeder modification.
Figure 11B:
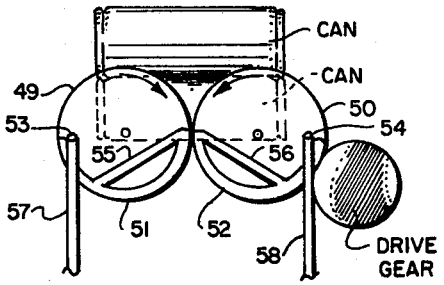
Figure 11C:
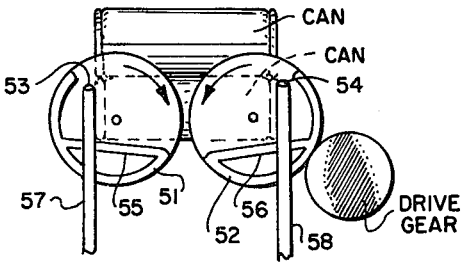

The interior of the device is partially illustrated in the elevational views of FIGS. 11A, 11B and 11C. Upper gears from one side of the crushing mechanism are illustrated in FIGS. 11A, 11B and 11C. (The lower gear arrangement would be similar to that illustrated in FIGS. 1 and 2.)

The upper gears 49 and 50 in FIG. 11A each have a curved fender or shoe 51 and 52 attached along about the perimeter of the gear. One-half to about threefourths of the fender must be sufficiently long to provide support for the bottom can except during such period when the can is entering a position between the crusher faces. The leading edge of such fender or shoe is close to the upper connection means, e.g., a pin or axle, which attaches the crushing face to the gear. The leading edge of the fender is preferably substantially coterminous with the pin or axle 53 and 54 which attaches the upper portion of the crushing face to the gear.

Each fender preferably has an inner shelf 55 and 56 associated with it. The shelf or strut is preferably a straight, flat piece having about the same width as the fender. The shelf extends from the inner trailing end of the fender to a point about midway along the inner arc of the fender.

Figure 12:
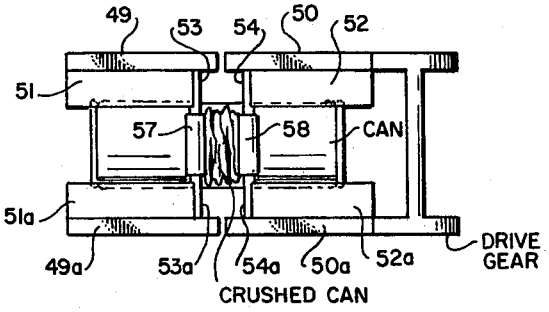
FIG. 12 is a plan exposed view of the upper gear mechanism and automatic can feeder mechanism.

In FIGS. 11A and 12 the curved fenders 51 and 52 are shown supporting the bottom can of a stack of cans above the crushing mechanism. The jaw faces 57 and 58 are in a position approaching their proximal position. A crushed can is undergoing further compaction. The bottom two cans of the vertical stack are shown as "ghosts" by the dotted lines.

The mechanism is illustrated in a plan view in FIG. 12. (Both sides of the mechanism are illustrated in FIG. 12.) An uncrushed can rests upon the quartet of fenders 51, 51*a*, 52 and 52*a*. The can is slightly wider than the space between opposed fenders 51 and 51*a*, and is thus cradled in position. (The spacing between opposed fenders 52 and 52*a* is the same as that between fenders 51 and 51*a*.) Fender 52 is in longitudinal alignment with fender 51.

The width of each fender is the same. The width of the fender may vary depending upon the width of the device. The width of the fender is such that the space between opposed fenders is somewhat narrower than the diameter of the smallest diameter can which the mechanism is designed to crush. Since the width of the crusher faces 57 and 58 must be no greater than the space between opposed fenders, it is generally desired to have an optimum width for such space, i.e., a space which will permit cans of varying diameters to be cradled between opposed fenders without causing the face width to be unduly narrow.

The width of the crusher face is desirably about fifty percent (50%) to about ninety percent (90%) of the width of the various cans sought to be crushed. The spacing between opposed fenders is thus about eighty percent (80%) to ninety percent (90%) of the diameter of the narrowest can to be crushed and about fifty percent (50%) to sixty percent (60%) of the diameter of the largest diameter can to be crushed. Preferably, the spacing varies from about sixty percent (60%) to eighty percent (80%) of the diameters of various commonly sized aluminum beverage cans.

As the gears revolve from a position illustrated in FIG. 11A to a position shown in FIG. 11B, the crushed can is discharged and the surface of the fenders cease to contact the bottom can of the stack. As the gears rotate, the interior edge adjacent the trailing edge of each of the fenders comes in contact with the bottom can. At the position shown in FIG. 11B, the bottom can is resting between opposed edges of shelves 55 and 55*a* and shelves 56 and 56*a*. (Shelf 55*a* is directly beneath fender 51*a* in FIG. 12 and shelf 56*a* is directly beneath fender 52*a* in FIG. 12.) Thus, the "bottom" can continues to be cradled and is supporting the second can and the remaining cans in the stack of cans.

As the gears continue to rotate they eventually bring the mechanism to the position shown in FIG. 11(*c*) wherein the faces 57 and 58 are just contacting the ends of the can. The can is leaving the cradle between shelves 55 and 55*a* and 56 and 56*a*. The faces contact most of the end of the can except a small portion which is adjacent to the second can. The jaw faces must not enter so high as to contact any portion of the second can. Thus, as the faces continue to move along an arcual path from the position shown in FIG. 11C to that shown in FIG. 11A, the can becomes substantially crushed.

Furthermore, the arcual movement of the faces elevates the bottom can during the initial crushing stage, thereby also elevating the second can. As the pins 53 and 54 pass the 12 o'clock position, the leading surfaces of the fenders 51 and 52 come into contact with the second can, which now becomes the new bottom can of the stack.

Since the jaw faces 57 and 58 do not overlap the upper edges of the ends of the horizontally disposed cylindrical can, the second can in the stack is not caught or crimped by the faces. However, the crushing action is very effective so long as the plates contact something more than about fifty percent (50%) of the diameter of the can lid or end. Preferably, the faces contact at least sixty percent (60%) of the vertical diameter of the can end. The faces preferably contact about eighty percent (80%) to ninety percent (90%) of the diameter of cans having a smaller diameter and about sixty percent (60%) to eighty percent (80%) of cans having a larger diameter. (It should be noted that contact is about seventy-five percent (75%) of the vertical diameter, measuring from the bottom, the end area contacted is about eighty percent (80%) of the total area of the can end.)

The mechanism illustrated in FIGS. 11 through 12 is a simple, effective can feeding and crushing mechanism. For example, the stack of cans can have a predetermined number of cans in the stack. Naturally, the crusher can be operated manually by turning on the switch and then turning it off when there is no longer a "crushing sound" being emitted from the crusher.

Once the machine is activated, it automatically feeds and crushes a stack of cans without further attention. Any type of sensing mechanism which senses an empty stack can be used to turn off the machine. Also, a simple timing mechanism can be used to shut off the machine after the expiration of a particular time interval. (The time required for crushing a given number of cans will always be the same. This can be determined and a time device preset to turn off the machine after passage of such a time interval.)

In a typical device of the type illustrated in FIGS. 10, 11 and 12 for crushing typical twelve ounce beverage cans having nominal dimensions of about two and one-half inches to about five inches, and slight variations thereof, the elements of the device have the following dimensions: Gears (49,50)—3-½ inches; Fender—1 inch width; Shelf—2 inch length and 1 inch width; Face—2 inch width by 4 inch height.

Generally, the apparatus and method of this invention have significant advantages as can crushers for cylindrical cans, for example, the action does not shear or tear the can and it does not have to crush the thickest part of the can which is typically found in the top and bottom lids. This is especially true of aluminum cans and aluminum-steel combination cans wherein the sidewalls are aluminum. The can is crushed into a compact form having small overall dimensions. A final crushed product is obtained which has no sharp edges and which will handle easily, that is, it will not bind nor bridge in bulk storage.

The finished product is substantially the same each time so there is reproducability of the crushed product. Also, crushing a can along its longitudinal axis produces very little noise. Can crushers of this invention can be installed in a restaurant, tavern or other business establishment without producing an objectable noise level. The crushing of a typical beverage can produces far less noise by the apparatus described herein than the typical garbage disposal unit used in a modern kitchen.

The gear system has many advantages over a hydraulic system which cover more crusher faces in a reciprocal fashion. As mentioned before, the faces are locked in a parallel relationship and there are no slides or guides that are required in the systems disclosed in FIGS. 1, 2 and 3. There is no danger of the faces binding when there are no slides or guides involved in a continuous action. Also, as the faces illustrated in FIGS. 1, 2, 3 and 11, for example, move towards and away from each other the circular motion of the faces provides a continuous action which is not provided by straight line reciprocation as produced by a hydraulic system.

The rotational movement of the crusher faces of the crusher illustrated in FIGS. 1, 2, 3 and 11 is particularly effective and efficient. The same portion of each crushed face stays in contact with the can during the entire crushing cycle. Also, the provision of four gears (two on each side) of each crusher face is advantageous inasmuch as the crusher face cannot become skewed or canted. Also, the crusher works effectively regardless of the position of the can between faces, i.e., it does not matter if a can is closer to an edge of a crusher face or to one crusher face.

The construction and operation of the can crusher described herein is further advantageous since the crusher can be compact lengthwise while still accepting cans in a lengthwise orientation. The construction does not involve axles between crusher gears which extend the width of the device. Thus, the face plate may make a complete revolution without interference from elements behind the plate.

The throw of an individual face is approximately the same as the diameter of the gears to which it is attached. Thus, four inch diameter gears may provide a throw of at least three inches per plate or a throw of six inches for two plates. Also, the pins attaching the crusher plates to the gears revolve within bearings so that much less wear is involved than in machines which use cams to drive the crusher plates.

I claim:

1. A method for crushing cylindrical cans along their longitudinal axes by:

positioning a can so that its longitudinal axis is substantially perpendicular to and between a pair of substantially parallel opposed planar faces;

moving each face along an arc towards the opposed face while maintaining the parallel relationship of said faces until the faces reach a proximal position with respect to one another;

continuing movement of each opposed face along the same arc with the faces moving away from one another until the faces reach a distal position with respect to one another.

2. The method of claim 1 wherein the moving of each face is upward and towards the other face when said faces are moving from a position of maximum distance therebetween.

3. The method of claim 1 wherein each face is moved in a complete circle from distal to proximal to distal position during each cycle of the movement of the faces.

4. An apparatus for crushing cylindrical cans along their longitudinal axis comprising:

means for positioning a cylindrical can so that its longitudinal axis is substantially perpendicular to and between a pair of substantially parallel, opposed, substantially planar faces;

means for moving each face towards the other along an arcual path while maintaining the faces in a parallel relationship until the faces reach their closest position with respect to one another;

means for continuing the movement along said arcual path with the faces moving away from each other until the faces reach a position where they are farthest apart.

5. The apparatus of claim 4 wherein the means for positioning said cylindrical can moves during the crushing of a can to avoid interfering with said crushing action.

6. The apparatus of claim 4 wherein the means for moving each face towards the other comprises a quartet of rotatable elements having a common length between their own individual axes of rotation and a point of connection to each of said faces.

7. The apparatus of claim 6 wherein the rotatable elements are two pair of gears attached to each face, one pair of gears located along opposed edges of the planar faces with the individual gears of a pair being located one above the other and intermeshing.

8. The apparatus of claim 4 wherein the means for moving each face towards the other is the same means which moves each face apart after the faces have reached their proximal position.

9. A cylindrical, can crushing apparatus comprising:

opposed sidewall support members;

four gears rotatably attached to the interior surface of each sidewall member, said gears being all of the same diameter and each set of four gears having individual gear centers located at the corners of a rectangle with each gear of one set of four gears being directly opposed to an individual gear of the set of gears attached to the opposed sidewall;

at least one drive means to drive at least one gear of each set of four gears;

a pair of opposed planar plate means, each plate means rotatably attached to two pairs of gears, one pair of gears from each set of four gears wherein all gears attached to one plate rotate in the same direction and wherein each plate is attached near the outer perimeter of each gear to which it is attached;

prime mover means connected to said drive means;

positioning means to position a cylindrical can between said opposed planar faces so that the longitudinal axis of said can is substantially perpendicular to each planar plate means.

10. The apparatus of claim 9 wherein said drive means drives a pair of gears of each set of four gears.

11. The apparatus of claim 10 wherein the two gears in contact with said drive means each drive another gear of the set of four gears.

12. The apparatus of claim 4 wherein said means for positioning a cylindrical can comprises a plurality of can positioning members associated with said opposed, substantially planar faces wherein said positioning members are located on either side (edge) of each planar face to form a cradle oriented such that said can is oriented with its longitudinal axis substantially perpendicular to said planar faces wherein each planar face has a width slightly less than the width of a can to be crushed, said positioning members movable to a first position which prevents a can from passing between said positioning members and to a second position for positioning said can substantially between said planar faces.

13. An apparatus for crushing cylindrical cans along their longitudinal axis comprising:

rotating positioning means rotatable to a first position whereby a can is held at an elevated position above opposed substantially planar faces and rotatable to a second position for positioning a cylindrical can so that it longitudinal axis is substantially perpendicular to and substantially between a pair of substantially parallel, opposed, substantially planar faces;

rotating means for moving each face towards the other along an arcual path while maintaining the faces in a parallel relationship until the faces reach their closest position with respect to one another; and for continuing the movement of said faces along said arcual path with the faces moving away from each other until the faces reach a position where they are farthest apart.

14. An apparatus for crushing cylindrical cans along their longitudinal axis comprising:

a pair of substantially parallel, substantially vertical planar faces, said faces being substantially rectangular with the height of each face being greater than its width;

two pairs of disk-like circular upper gears, the gear of each pair being identical to the other and having a face parallel to the other and each gear of a pair having its axle located on the same axis, all axles being located at the same elevation and one gear of each opposed pair meshing with a gear of the other opposed pair, the upper edge of each face being attached to one pair of opposed gears near the periphery of each gear so that a line connecting said points of attachment is substantially perpendicular to each gear;

two pairs of disk-like circular lower gears, each of said lower gears located directly beneath an upper gear and having the axle of each lower gear substantially vertically aligned with the axles of its respective upper gear, the lower edge of each of said planar faces being attached to a pair of opposed lower gears so that said planar face remains in a substantially vertical position when the gears attached to one face are rotated synchronously in the same direction while the gears attached to the other planar face are rotated in an opposite direction at the same rotational speed as the gears attached to the one face;

curved fender means associated with said top gears whereby said fender means have substantially the same radius of curvature as the radius of each of said gears whereby said fender is located near the periphery of said gears and extends along said periphery for about 180° and whereby the leading edge of said fender is attached to back said gear near the upper edge of each face and whereby the width of each fender is sufficient that the space between it and its opposed fender is slightly smaller than a can to be crushed and whereby such spacing is substantially the same as the width of each said planar face.

* * * * *